United States Patent [19]

Johnson, Jr.

[11] Patent Number: 4,763,558

[45] Date of Patent: Aug. 16, 1988

[54] METHOD AND APPARATUS FOR GENERATING AND REPRESENTING CHORD NOTE POSITIONS OF A STRINGED INSTRUMENT

[76] Inventor: Jesse W. Johnson, Jr., Rte. 2, Box 212, Archer, Fla. 32618

[21] Appl. No.: 898,319

[22] Filed: Aug. 20, 1986

[51] Int. Cl.[4] ..... G10B 15/00

[52] U.S. Cl. ..... 84/485 R

[58] Field of Search ..... 84/470 R, 477 R, 471, 84/485 R, 478, 479 A, DIG. 6

[56] References Cited

U.S. PATENT DOCUMENTS

| | | | |
|---|---|---|---|
| 4,295,406 | 10/1981 | Smith | 84/485 R X |
| 4,412,473 | 11/1983 | Laflamme | 84/485 R |
| 4,559,861 | 12/1985 | Patty et al. | 84/485 R X |

*Primary Examiner*—W. B. Perkey
*Attorney, Agent, or Firm*—Hale and Dorr

[57] ABSTRACT

A method and apparatus for exhaustively determining the chord note positions for selected chord types for a stringed instrument determine for each chord type and each allowable combination of at least three fret positions, all allowable valid combinations of chord note positions for playing the chord. The method and apparatus then graphically output for each chord type and each allowable combination of fret positions the allowable combinations of chord note positions. The method provides for graphically representing, on a single grid, a plurality of positions for playing a selected chord on a stringed instrument. The method uses a substantially orthogonal coordinate system to represent string location on a first axis and fret position on a second axis. Each valid string-fret position intersection corresponding to a note of the chord is graphically portrayed on the grid at the intersection. The exhaustive representation of grids, representing different chords and different fret positions, is presented in a regular array wherein the chords are indexed along a first axial direction and the fret locations are indexed along a second axial direction.

16 Claims, 6 Drawing Sheets

| NOTE/GRAPHICS | NUMERIC |
|---|---|
| A | 11 |
| B♭ | 12 |
| B | 13 |
| C | 14 |
| C# | 15 |
| D | 16 |
| E♭ | 17 |
| E | 18 |
| F | 19 |
| F# | 20 |
| G | 21 |
| A♭ | 22 |
FIG. 3
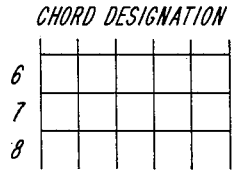
FIG. 6
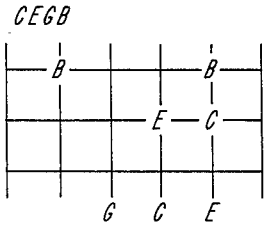
FIG. 7

METHOD AND APPARATUS FOR GENERATING AND REPRESENTING CHORD NOTE POSITIONS OF A STRINGED INSTRUMENT

BACKGROUND OF THE INVENTION

The invention relates generally to stringed musical instruments and in particular to a method and apparatus for determining chord positioning on a stringed instrument and the representation of the chord positions for creative and easy use.

Many people who play a stringed instrument, such as the guitar, do not read music. Instead, songs are learned by playing the chords as an accompaniment to a lead instrument or singer that carries the melody. This method of playing the instrument is often referred to as playing "by ear." Playing the instrument by ear sometimes involves the use of what is often known as "Fake Books" which give the words to a song and a notation indicating when the chord or chords are to be played. Sometimes these books also show the finger positions for the chords but more often they do not. If the position is not shown, the musician must attempt to find the chord in a chord book which may or may not contain the chord of interest. If the chord is found, the reference source often provides only one option for playing the chord, leaving open the question of whether or not there is another position for playing the chord. Accordingly, some of the positions shown in a prior art collection of chords may provide positions which are uncomfortable to the user, and in particular to a beginner, and which deprive the more advanced player of the option of choosing from various positions for the sake of both tonal color or location.

Various types of chords are typically associated with a certain style of music. However, the available collections of chords are generally "standard" tuning and do not provide for arbitrary tuning of the stringed instrument. Furthermore, it is often that a particular style of music is more associated with one portion of the neck of the stringed instrument, such as a guitar; however, it is often useful, but not available, to know other locations on the guitar neck for providing the same chord to enable the creative generation of music by the musician.

Prior representations of chord fingering provide the musician with one set of positions for playing a chord. To provide the musician with more options, it is desirable to develop a different representation of chord positionings so that the musician can select that positioning which is most comfortable to him or which provides the best tonal quality.

It is therefore an object of the invention to provide an exhaustive generation of the chord note positions of selected playable chord types for a stringed instrument. Another object of the invention is to represent all playable combinations for a given chord and selected fret positioning in a single grid representation. Further objects of the invention are a method and apparatus for generating the chord representations which are reliable, which eliminate invalid or unavailable positioning combinations, and which can be presented in a logical and easily used visual presentation.

SUMMARY OF THE INVENTION

The invention relates to a method and apparatus for determining the chord note positions of selected playable chord types for a stringed instrument. The method features exhaustively determining the chord note positions for the selected chord types. The method features designating or inputting data parameters describing the instrument and the chords of interest, for example, the number of strings for the instrument, the tuning of the instrument, the chord types for which the playable note positions will be determined, and the allowable fret positions for playing the chords on the instrument. With these input parameters specified, the method then features determining for each chord type and each allowable combination of at least three fret positions, all allowable combinations of chord note positions for playing each chord. The method further features graphically outputting for each chord type and each allowable combination of the at least three fret positions, the allowable combinations of chord note positions.

In a particular embodiment, the method features graphically outputting on a single grid background, a representation of all such allowable combination(s) of chord note positions.

In a particular embodiment of the invention, the determining step features the steps of determining a note corresponding to each combination of a string and allowable fret position for the instrument based upon the input parameters; comparing, for each note of a selected chord, the notes corresponding to at least three fret positions for each string; storing, for each chord note which matches the note at a string-fret position intersection, a representation of the location of the match, and editing the noted matches to render invalid those matched string-fret notes which correspond to notes which cannot be played or used in forming the chord.

Preferably, the editing step features, for each successive chord-"moving fret window" combination, the steps of checking that each note of a chord occurs in at least one match; removing or eliminating for each chord note for which there is exactly one match, all other matched string-fret notes on the same string; removing or eliminating, for each chord note for which there are exactly two matches, both occurring on the same string, all other matched string-fret notes on that same string; removing or eliminating for each chord note pair, each note of the pair occurring exactly twice and one match from each pair occurring on each of two different strings whereby the notes have a mutual interdependency, all other matched string-fret notes on the two different strings. In the described embodiment of the invention, all editing steps are repeated at least once since editing according to one step can require further editing according to the same or another editing step.

The apparatus of the invention, for exhaustively determining the chord note positions of selected chord types for a stringed instrument, features means for inputting or otherwise designating data parameters which describe the instrument and the chords of interest. The data parameters include the number of strings of the instrument, the tuning of the instrument strings, the chord types for which the playable note positions will be determined, and the allowable fret positions for playing the chords on the instrument. The apparatus further features elements for determining, for each chord type and each allowable combination of at least three fret positions, all allowable combinations of chord note positions for playing the chord, and means for graphically outputting, for each chord type and allowable combination of at least three fret positions, the allowable combinations of chord note positions.

In a preferred embodiment, the apparatus provides circuitry for graphically outputting on a single grid representation, all of the allowable combination(s) of chord note positions.

In a preferred aspect of the invention, the determining element of the invention features means for determining a note corresponding to each combination of a string and a fret position for the instrument based upon the input parameters; means for determining for each note of a selected chord, the corresponding notes of the at least three fret positions for each string; means for storing, for each chord note which matches the note at a string-fret position intersection, a representation of the location of the match; and means for editing the note matches to render invalid those matched string-fret notes which correspond to notes which cannot be played or used in forming the chord.

In another preferred aspect of the invention, the editing means features, for each successive chord-"moving fret window" combination, means for checking that each note of a chord occurs at at least one string-fret position; and circuitry for removing or eliminating for each chord note, for which there is exactly one match, all other matched string-fret notes on the same string. The circuitry further features elements for eliminating or removing, for each chord note for which there are exactly two matches, both matches occurring on the same string, all other matched string-fret notes on that same string; and circuitry for eliminating or removing, for each chord note pair, where each note of each pair occurs exactly twice and one note match from each pair occurs on each of two different strings whereby the notes have a mutual dependency, all other matched string-fret notes on the two different strings.

In another aspect of the invention, the apparatus further features circuitry for repeating, at least once, the operation of the checking and removing means for final editing of the matches which have been found, since editing by one means can require further editing by the same or another editing means.

In another aspect, the invention features a method for graphically presenting, on a single grid representation, a plurality of note positions for playing a chord in a plurality of note combinations on a stringed instrument. The method features the step of generating graphically a substantially orthogonal coordinate system for representing string location along a first axis and fret position along a second axis. The method then identifies graphically at each string-fret position intersection, the note of the chord, if any, available at that intersection. In a preferred embodiment, the method further features identifying graphically, for each string represented, the note associated with the open string when that note is valid and corresponds to a note of the chord being represented.

In yet another aspect of the invention, a graphical display system for displaying an exhaustive representation of chord note positions for selected chord types and playable on a stringed instrument features a regular array of grid element representations, each grid element representing along a first axis the strings of the instrument and along a second axis a selected set of fret locations on the instrument. The grid elements of each array are arranged in a matrix having a first axial direction corresponding to each chord type and a second axial direction corresponding to the selected set of fret locations, each set having at least three fret positions.

BRIEF DESCRIPTION OF THE DRAWINGS

Other objects, features, and advantages of the invention will appear from the following description of a preferred embodiment taken together with the drawings in which:

FIG. 3 is a table associating the musical notes with the numeric graphics for use in connection with the flow diagrams of FIGS. 2 and 4;

FIG. 6 is a typical graphical output representation when the chord cannot be played under the selected input parameters defining the instrument and the fret positions; and FIG. 7 is an example of an intermediate grid representation for illustrating the detection and analysis of mutually dependent note pairs.

DESCRIPTION OF A PREFERRED EMBODIMENT OF THE INVENTION

Figure 1:
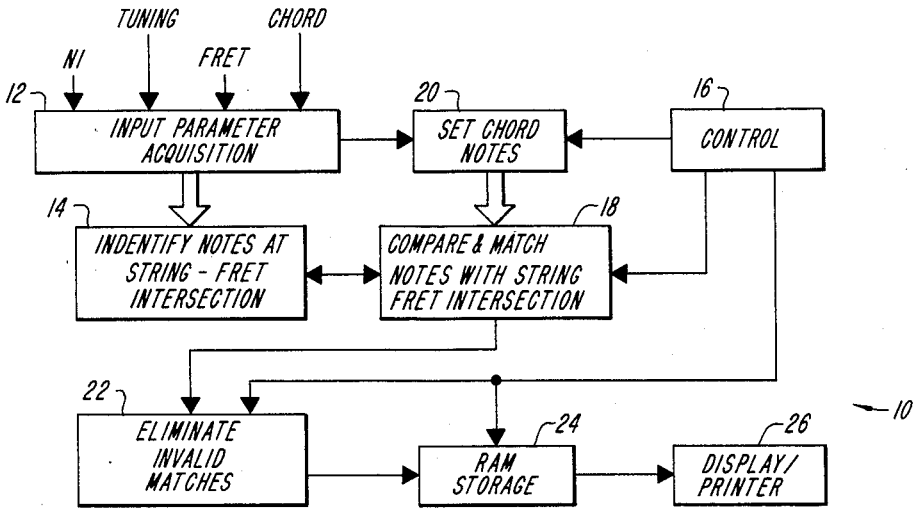
FIG. 1 is a circuit diagram of a preferred embodiment of the invention.

Referring to FIG. 1, an apparatus 10 for exhaustively determining the chord note positions for playing selected chords on a selected stringed instrument has a circuitry 12 for acquiring input data parameters such as the number of strings on the instrument (Ni), the tuning of the instrument (for example the standard guitar tuning), the location of the frets of the instrument where the chords will be played (typically one can provide chords for all of the fret locations on the instrument although a subset of these locations could be selected as the allowable positions), and the chord types of interest. The general chord types of interest might be, for example, major chords, minor chords, augmented chords, suspended chords, and diminished chords. Within each of the general chord classifications, there are a plurality of specific chords such as, for example, the major chord, the major sixth chord, the major six-nine chord, etc.

Having the input parameters available in memory, for example, within circuitry 12, the apparatus identifies for each combination of a string and a fret position, (hereafter the string-fret position intersection), the note which will be played when the string is strummed and held at the corresponding fret position. The apparatus identifies the notes for all string-fret position intersections and stores that information using, for example, a circuitry 14. The apparatus then, under the control of a sequence control processor 16, compares, on a chord by chord basis, using a comparison circuitry 18, the notes at each string-fret position intersection within a "moving fret window" with the chords for which note positions are to be determined. The chords are sequenced one by one using a chord sequence acquisition circuitry 20 to acquire, from the input parameter storage circuitry 12, the notes of each chord. The chords are selected in a predetermined sequence in the illustrated embodiment of the invention. The notes of a chord are compared by circuitry 18 with a limited extent of the string-fret position intersections. The particular string-fret position intersections are specified by the control sequencer 16 which uses what has been characterized as a "moving fret window." The "moving fret window" is designed to select a limited number of fret positions, for example three sequentially adjacent fret positions, and to compare the notes corresponding to those selected string-fret position intersections with the notes of the selected chord. The "moving fret window" thus defines the string-fret position intersections for which the comparison will be made and the "window" typically increments for movement along the neck of the instrument within limits set by the input data. In a default condition, the "window" can increment along the entire neck of the instrument.

Thus, for each note of a selected chord, the comparison circuitry 18 determines the matches with the note elements of the "matrix" formed by the string-fret position intersections defined by the "moving fret window." The control circuitry 16 then operates through a circuitry 22 to eliminate invalid matches and the remaining valid matches are passed to a storage element 24. Under the control of the sequencing processor 16, the storage element 24 passes groups of data to a display unit or printer 26 for a visual display and/or hard copy output.

Figure 4A:
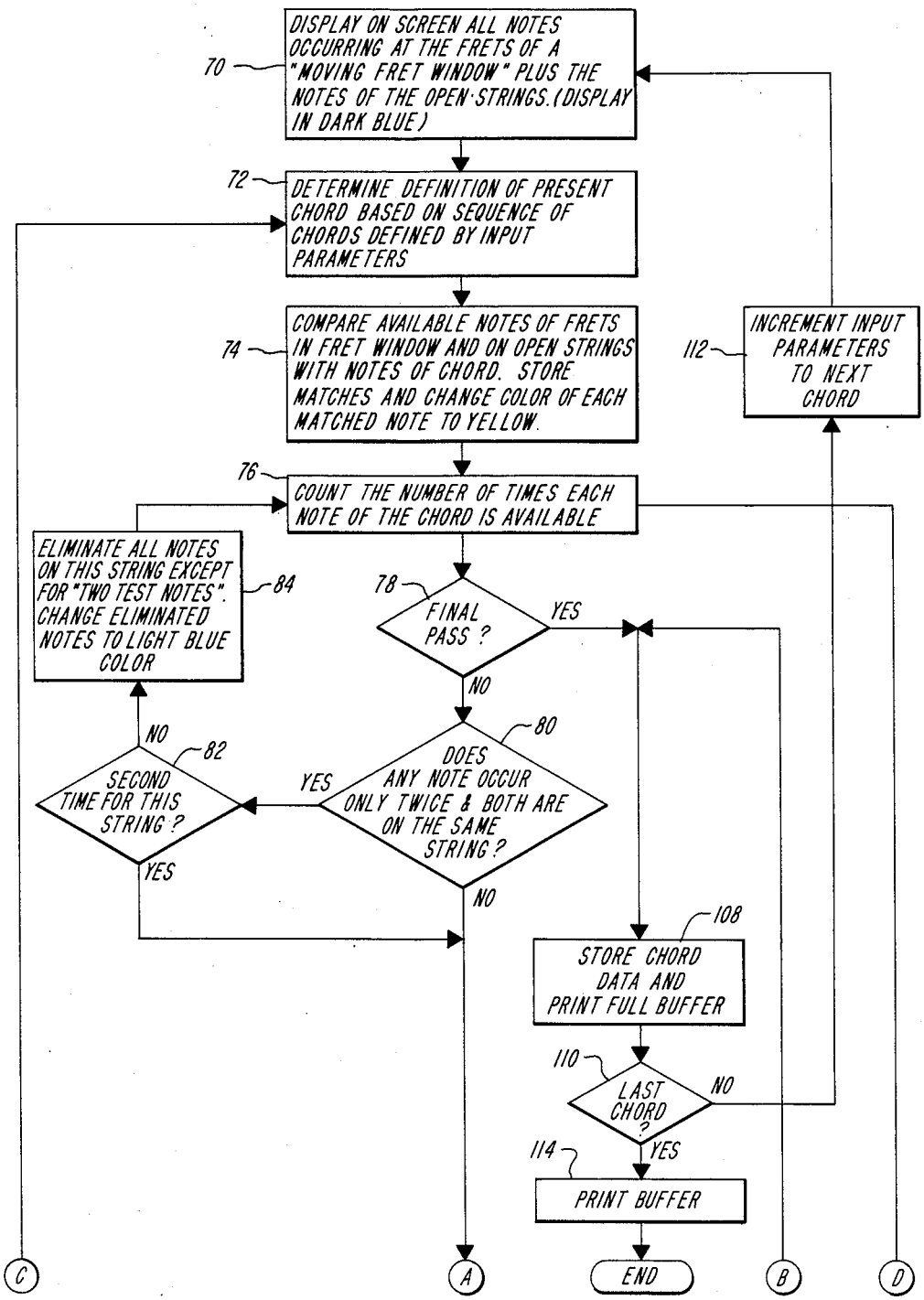
FIGS. 4A, 4B, and 4C represent a detailed flow diagram of the method for generating and editing the exhaustive chord note positions based upon the input parameters to the system.
Figure 4B:
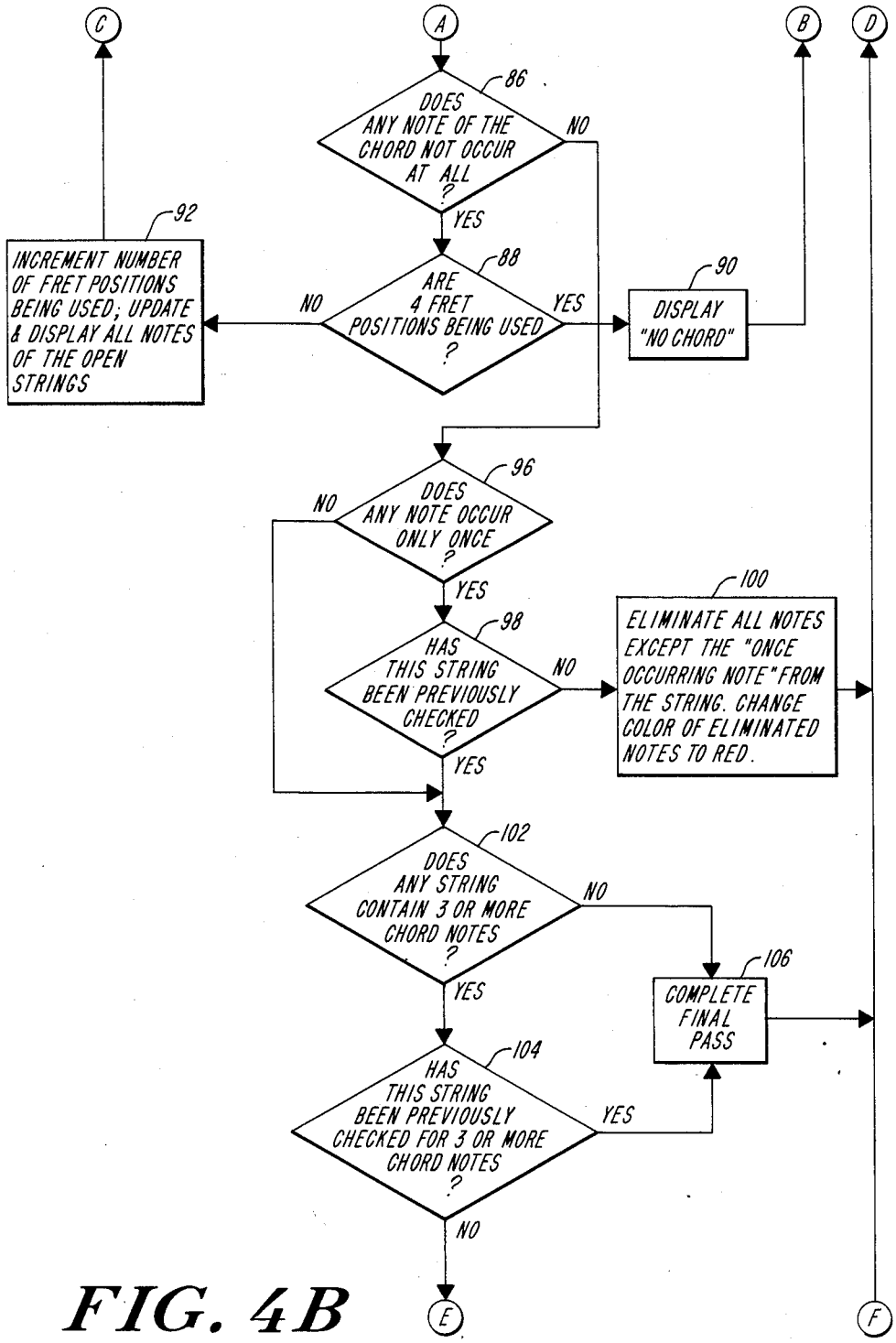
Figure 4C:
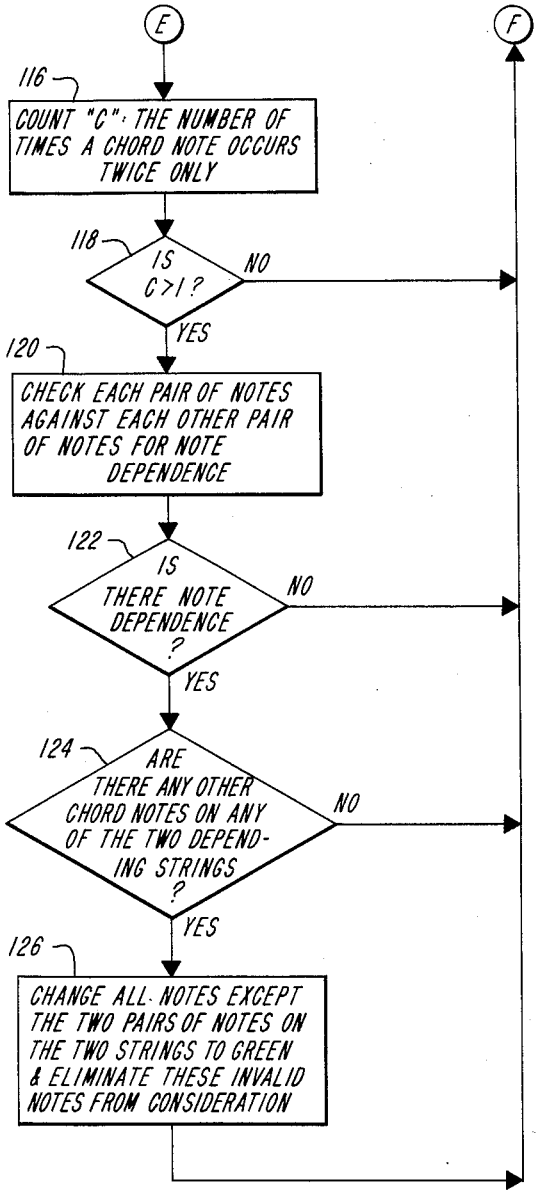
Figure 5:
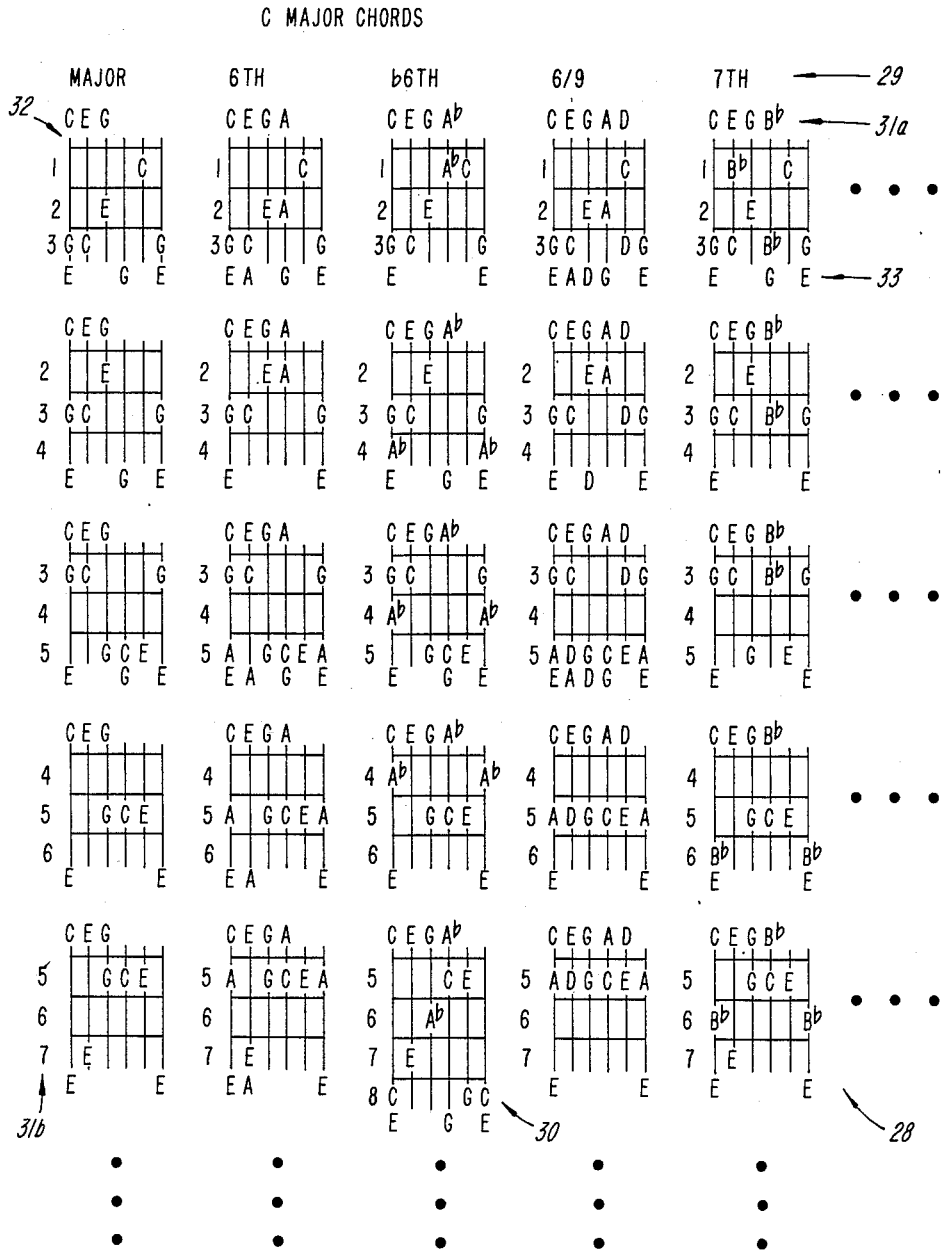
FIG. 5 is a typical representation of the results of the method and apparatus of the claimed invention showing a partial array of overwritten grid elements representing the notes available to play a selected chord.

The result is, in the illustrated embodiment, a grid pattern representation such as that depicted in FIG. 5. FIG. 5 is a small portion of the graphical output for guitars having a standard tuning. Along one axis of the display array 28 are designated the chords 29. The particular chords shown are C major chords, and in particular C major, C major sixth, C major flat sixth, C major six nine, and C major seventh. Along the other axis of the array 28 are designated the fret positions for which the note comparisons have been made. Thus, for the first row of the array, the selected fret positions are the first, second, and third fret positions. For the second row, the "moving fret window" is incremented one position so that the selected fret positions are the second, third, and fourth positions. The "moving fret window" is again incremented in the third row, and moves up the neck to and including, in the last illustrated row, the fifth, sixth, and seventh positions. Note, however, that for the grid labeled 30, the eighth fret position is also included. This occurs, as is described in more detail in connection with FIG. 4, for a condition in which the three fret positions do not provide the notes necessary to play the particular chord.

For each grid representation, the grid is labeled above, at 31*a*, with the notes of the chord and on its side, at 31*b*, with the fret positions. The grid itself has overlaid on it at each position for which a valid match occurs, the particular note which can be played at that position. Thus, referring to grid 32, on the E string of a standardly tuned guitar, at fret 3, the note G can be played. In addition, for those open string notes which match the notes of the chord, the open string notes are represented in a row below the grid, for example, at 33. Thus, for the grid 32, the open string positions for the E, G, and E strings are listed. A similar analysis can be made for the next chord, the C major sixth chord which includes the notes C, E, G, and A.

In accordance with the invention, the method and apparatus can be implemented in either hardware, software, or a combination of the two. In the illustrated embodiment to be described hereinafter, the method and apparatus of the invention have been implemented in a software configuration comparable to the hardware configuration of FIG. 1.

Figure 2:
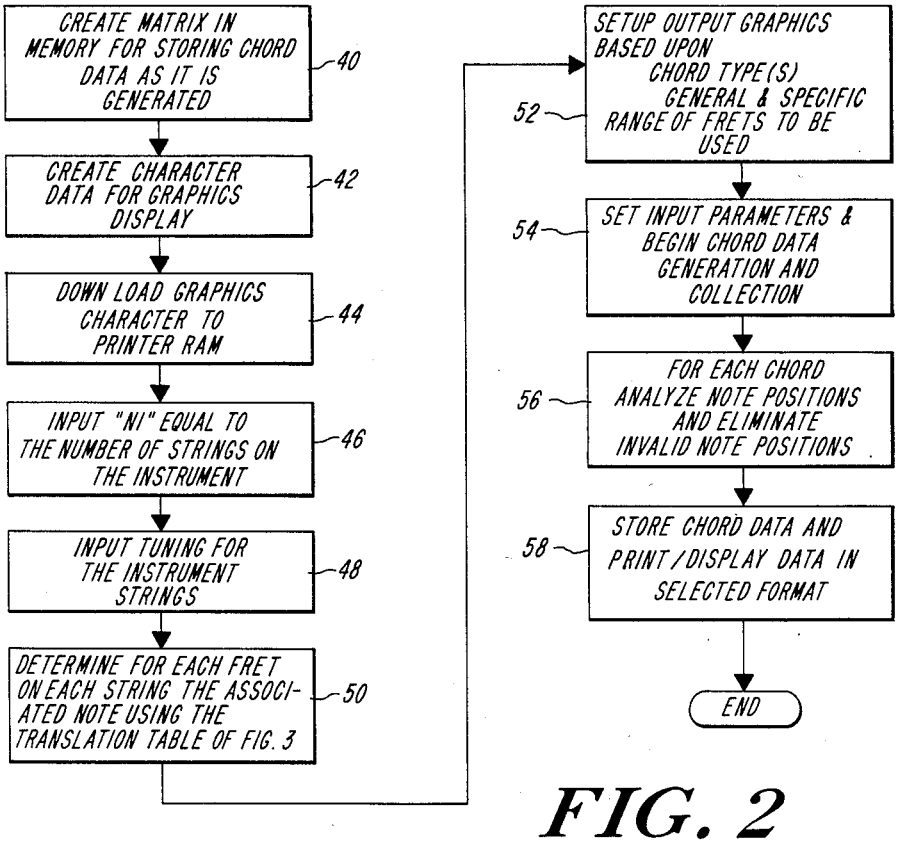
FIG. 2 is a general flow diagram of the steps of the method in accordance with the invention.

Referring to FIG. 2, the software, at 40, first creates in memory a matrix storage for storing the chord data as it is being generated. The apparatus then, at 42, creates the character data which will be used for generating a graphics display. The display can be viewed on a cathode ray tube monitor or screen, or can be printed by a bit map printer onto what is often described as a hard copy. The graphics characters are then downloaded to a printer RAM at 44 so that the printer portion of the apparatus is able to accommodate the particular representations employed in accordance with this embodiment of the invention.

The input data parameters are then read. The particular embodiment of the program presented herein is a user interactive program. The user not only provides the input parameters required to enable the generation of the required graphics output, but in addition, the processor displays over a color monitoring system the progress of the program as it processes a chord at each position of the "moving fret window." Thus, at 46 and 48, the details of the instrument are input to the system. Those details include the number of strings on the instrument (at 46) and the tuning of the instrument strings (at 48).

The apparatus then determines, for each fret position on each string, the associated musical note which is played when that fret position is used. The matrix of data representing these notes is generated at 50.

The program then, at 52, sets up the output graphics based upon the chord types and the range of frets for which a grid representation output will be generated. While the frets and the chords can be individually selected for the particular use and application, in this illustrated embodiment of the invention, a "moving fret window," the window fret pattern being three consecutive frets, is used. The "moving fret window" sequentially increments from fret position 1 through fret position 17. As will be described hereinafter, there are circumstances where the window is widened without being incremented in an attempt to find a playable chord. In other embodiments of the invention, different fret patterns can be used.

Similarly, in this illustrated embodiment, specific chords are preselected for each of the general chords enumerated above. Thus there are sixteen major and sixteen minor chords in accordance with the described embodiment, and thirteen chords for each of the diminished chords, the augmented chords, and the suspended chords. For each combination of the chords and the incremental positions of the "moving fret window," the chord data generation and collection is begun at 54. The data collection for each chord and location of the "moving fret window" is analyzed to generate the grid representation illustrated in FIG. 7. The collection of grid representations for all chords and "windows" is presented in an array corresponding to FIG. 5.

The results of the exhaustive search implemented at 54, for all notes at the fret positions defined by the "moving fret window" which match the selected chord, are candidate matches which must then be analyzed, at 56, to eliminate any invalid note positions. An invalid note position can result, for example, from an instance where the playing of one note of the chord will eliminate the possibility of playing another "matched note" of the chord. This is described in more detail in connection with the detailed analysis flow chart of FIG. 4.

Once the invalid note positions have been eliminated, the chord data is stored in, for example, a buffer area of memory and the data is output, at 58, to a printer and/or visual display monitor in a selected format, such as the format of the grid array shown in FIG. 5. Thus, the entire exhaustive display for the input data provided is made available to the user as an ordered array defined by the chords and the fret positions. Each grid representation in the array provides the note positions for playing the particular chord, identified by the column heading, at the fret positions indicated by the row designations.

FIGS. 4A, 4B, and 4C together form a detailed flow chart of the analysis or editing portion of the method of the invention. According to this illustrated embodiment of the invention, as noted above, the method is interactive with the user so that the user can observe the processing of data and the forming of the grid representation as the process proceeds. In accordance with this illustrated embodiment of the invention, the method displays, at 70, on a monitor or other type display, a grid wherein the notes which occur at each fret position within the "moving fret window" are determined and displayed. The display also shows the notes of the open strings. All of the notes are displayed in a dark blue color.

As noted above, after all of the notes for this grid are generated, the apparatus determines and defines the present chord based upon the sequence of chords specified by the input parameters. This occurs at 72. The chords may be a standard sequence of chords such as that in part illustrated in FIG. 5 or may be a non-standard sequence defined by the user. In either instance, the method proceeds and exhaustively defines all available notes which match the chord within the defined "moving fret window."

The notes available at the fret positions within the "moving fret window" are compared, at 74, with the notes of the chord. The notes associated with the open strings are also compared with the notes of the chord. For each match, the locations and notes are stored in a buffer memory, and the color of each matched note is changed to yellow on the display monitor. During the editing or analysis that follows, some of the note matches may be shown to be invalid. As notes are eliminated from consideration for a chord, the eliminated or invalid notes will be shown in a color other than yellow so that, when analysis and editing are completed, only those notes remaining in a yellow color will appear in overlay on the grid, thereby representing the available note positions for a chord as shown in the selected array of FIG. 5.

The first editing step in accordance with the illustrated method is to eliminate from a string those notes which occurred in combination with a note or note pair which only appears on that string. In accordance with this aspect of the analysis and editing process, the method counts, at 76, the number of times each note of the chord has been found for this "moving fret window" position. The system then checks, at 78, to determine whether this is the final pass and if it is not, the test is made, at 80, to determine whether any note occurs only twice and if so whether both occurrences are on the same string. If this dual condition is met, the apparatus then checks, at 82, whether this condition had been previously noted by the system. If it has not been previously noted by the system, then all notes on that string, except for the two test notes which occur only on that string, are eliminated and considered invalid. The eliminated notes are changed in color to a light blue in accordance with this embodiment of the invention so that the viewer watching the monitor "sees" the operation of this "light blue" editor. This occurs at 84.

It is common during the editing and analysis process that changes effected by the system, that is, changes whereby certain invalid notes are eliminated from consideration, will have a domino effect by causing other potentially adverse conditions, not previously in existence, to occur. Thus, the elimination of some notes on one string may cause a condition on another string to be triggered such as, for example, to meet the test defined by block 80. Accordingly, therefore, the count at 76 is repeated after many of the test conditions have been checked and the entire edit procedure occurs again. The method continues to "loop" until a final pass is designated, as will be described in more detail below.

If the test at 80 is negative, or if that string has already been tested, the system then checks, at 86, whether any note of the chord does not occur at all. It must be noted at the outset that these tests could occur in other than the order provided. If any note of the chord does not occur at all in the data being tested, the method checks, at 88, whether a four fret-position, expanded moving fret window, is being used. If it is being used, then no chord can be played for this particular chord-fret position combination. The display shows, at 90, that no chord will be displayed and the method will print at this position a plain grid representation without any other markings as illustrated, for example, in FIG. 6.

If, on the other hand, four fret positions were not being used at 88, the method increments, at 92, the number of fret positions in the "moving fret window" and further updates and displays all notes plus the notes of the open strings for the incremented and hence widened window. The apparatus then loops back to block 74 to determine whether a match exists for this expanded function. If one or more valid matches exist, such as the notes at grid representation 30, it is thereafter printed as shown at grid 30, in FIG. 5, as a four fret grid.

If the test at 86 is negative, then the method tests, at 96, whether any note occurs only once. If a note occurs only once, then clearly that note must be played and, if this note has not been previously checked, as tested for at 98, then all other notes on the same string are considered invalid and are eliminated from further consideration. The "once occurring note" then becomes the only valid note on the string and the color of all of the eliminated notes is changed to red for viewing purposes. This is then called the red editor. This step is illustrated at block 100. After completion of this step the apparatus "loops back" to block 76 to recount the presently valid notes and test them again.

If no note occurs only once, the apparatus then checks, at 102, whether any string contains three or more chord notes. If there are none, or if there are one or more such strings but all such strings have been previously checked, as tested at 104, then the apparatus has completed its final pass for this combination of chord and selected fret positions, as indicated at block 106. The method then loops back to block 76 for storing the chord data at 108 and printing the output of the storage buffer if it is full. The data are tested at 110 to determine whether the last chord has been completely processed and, if it has not, the input parameters are incremented at 112 and the entire process repeats. If the last chord has been completely processed, the final data in the print buffer, if any, is printed at 114 and the analysis is complete.

The test at 102 begins the next "editor," the so-called green editor, which checks for a condition of mutual interdependence of the note matches. A typical instance of such interdependence is illustrated in FIG. 7. In FIG. 7, which represents an arbitrary guitar tuning and combination of fret positions, the note configuration available for a major seven chord, having the notes C, E, G, B, is shown as the method begins the test defined at block 102. The "problem" here is the mutual interdependence of notes C and E. Thus if the C string is used to play note E, then the E string must be used to play note C. Similarly, if the E string is used to play note E, then the C string must be used to play note C. Accordingly, therefore, it is for this mutual interdependence which the steps beginning at test 102 are designed to uncover and treat.

In accordance with the invention, therefore, the apparatus counts, at 116, the number of times a chord note occurs "twice only." In the example of FIG. 7, the resulting value of the variable "c" would be three. If the number is greater than one, as tested at 118, the apparatus checks each pair of notes against each other pair of notes for "mutual interdependence." This is checked at 120. If "c" is less than or equal to one, then the apparatus "loops back" to block 76. In the illustrated embodiment, referring to FIG. 7, the pair of notes B are checked against each of the pair of notes C and E and the pair of notes C are checked against the pair of notes E. There would then be noted, during the test procedure, at 122, mutual interdependence between the notes E and C. If there is no mutual interdependence, the apparatus loops back to block 76.

Since, in FIG. 7, there is mutual interdependence, the apparatus then checks, at 124, whether there are any other chord notes on any of the two depending strings (strings C and E in the illustrated example of FIG. 7). If there are (and there are in FIG. 7), then the other notes are changed to a green color and thereby eliminated, as invalid notes, from any further consideration. In the illustrated embodiment, the "B" note on string "E" would be changed to the color green. This is indicated at 126. Thereafter the apparatus loops back to block 76 to "redo" the entire process using the remaining valid notes matches.

In this manner, the apparatus edits and removes the invalid combinations of "matches" found at the initial process stage of the comparison. By eliminating the invalid notes, there result the note combinations which can be used to "play the chord."

Additions, subtractions, deletions, and other modifications of the described embodiment will be apparent to those practiced in the art and are within the scope of the following claims.

What is claimed is:

1. A method for exhaustively determining the chord note positions for selected chord types for a stringed instrument comprising the steps of designating the number of strings for the instrument, designating the tuning of the instrument strings, designating the chord types for which playable chord note positions will be determined, designating the allowable fret positions for playing the chords on the instrument, determining, for each chord type and each allowable combination of at least three fret positions, all allowable combinations of chord note positions for playing said each chord type, and graphically outputting, for each chord type and each allowable combination of at least three fret positions, said allowable combinations of chord note positions.

2. The method of claim 1 wherein said graphically outputting step comprises the step of graphically outputting on a single grid a representation of each said allowable combination of chord note positions.

3. The method of claim 2 wherein said graphically outputting step further comprises the step of graphically outputting said grid representations in a regular array, said grid elements of said array being arranged in a first axial direction corresponding to each chord type and in a second axial direction corresponding to said combinations of at least three fret positions.

4. The method of claim 1 wherein said determining step comprises the steps of determining a note corresponding to each combination of a string and allowable fret positions for said instrument, comparing each note of a designated chord type with the notes of said at least three fret positions for each said string, storing for each chord note which matches the note of a string-fret position intersection a representation of the location of the match, and editing the matches to render invalid matched string-fret notes which correspond to notes which cannot be played.

5. The method of claim 4 further wherein said editing step comprises, for each successive chord-"moving fret window" combination, the steps of checking that each note of a chord occurs in at least one match, removing for each chord note, for which there is exactly one match, all other matched string-fret notes on the same string, removing for each chord note for which there are exactly two matches, both occurring on the same string, all other matched string-fret notes on that same string, and removing, for each chord note pair, each note of said pair occurring exactly twice and one match from each pair occurring on each of two different strings, whereby the notes have a mutual interdependency, all other matched string-fret notes on said two different strings.

6. The method of claim 5 further comprising the step of repeating at least once said checking and all removing steps in editing the found matches when at least one match is found to be invalid.

7. The method of claim 5 further comprising the step of expanding the "moving-fret window" to include a greater number of fret positions up to a maximum number of fret positions, whenever said checking step determines that at least one note of a chord is not matched, and repeating said allowable combinations determining step.

8. A method for exhaustively determining the chord note positions for selected chord types for a stringed instrument comprising the steps of inputting the number of strings for the instrument, inputting the tuning of the instrument strings, inputting the chord types for which the playable chord note positions will be determined, inputting the allowable fret positions for playing chords on the instrument, determining a note corresponding to each combination of a string and allowable fret positions for said instrument, comparing each note of an input chord type with the notes of said at least three fret positions for each said string, storing for each chord note which matches the note of a string-fret position intersection a representation of the location of the match, checking that each note of a chord occurs in at least one match, removing for each chord note for which there is exactly one match, all other matched string-fret notes on the same string, removing for each chord note for which there are exactly two matches, both occurring on the same string, all other matched string-fret notes on that same string, removing, for each chord note pair, each note of said pair occurring exactly twice and one match from each note of the pair occurring on each of two different strings whereby the notes have a mutual interdependency, all other matched string-fret notes on said two different strings, repeating at least once said checking and all removing steps in editing of the found matches when at least one match is found to be invalid, and graphically outputting on a single grid, a representation of each said allowable combination of chord note positions.

9. Apparatus for exhaustively determining the chord note positions for selected chord types for a stringed instrument comprising means for designating the number of strings for the instrument, means for designating the tuning of the instrument strings, means for designating the chord types for which playable chord note positions will be determined, means for designating the allowable fret positions for playing chords on the instrument, means for determining, for each chord type and each allowable combination of at least three fret positions, all allowable combinations of chord note positions for playing said each chord type, and means for graphically outputting, for each chord type and each allowable combination of at least three fret positions, said allowable combinations of chord note positions.

10. The apparatus of claim 9 wherein said graphically outputting means comprises means for graphically outputting on a single grid, a representation of each said allowable combination of chord note positions.

11. The apparatus of claim 9 wherein said determining means comprises means for determining a note corresponding to each combination of a string and allowable fret positions for said instrument, means for comparing each note of a designated chord type with the notes of said at least three fret positions for each said string, means for storing, for each chord note which matches the note of a string-fret position intersection, a representation of the location of the match, and means for editing the matches to render invalid matched string-fret notes which correspond to notes which cannot be played.

12. The apparatus of claim 11 further wherein said editing means comprises, for each successive chord-"moving fret window" combination, means for checking that each note of a chord occurs in at least one match, means for removing for each chord note, for which there is exactly one match, all other matched string-fret notes on the same string, means for removing for each chord note for which there are exactly two matches, both matches occurring on the same string, all other matched string-fret notes on that same string, and means for removing, for each chord note pair, each note of said pair occurring exactly twice and one match from each pair occurring on each of two different strings whereby the notes have a mutual interdependency, all other matched string-fret notes on said two different strings.

13. The apparatus of claim 12 further comprising means for repeating at least once operation of said checking and all removing means in editing the found matches when at least one match has been declared invalid.

14. Apparatus for exhaustively determining the chord note positions for selected chord types for a stringed instrument comprising means for inputting the number of strings for the instrument, means for inputting the tuning of the instrument strings, means for inputting the chord types for which playable chord note positions will be determined, means for inputting the allowable fret positions for playing chords on the instrument, means for determining a note corresponding to each combination of a string and allowable fret positions for said instrument, means for comparing each note of an input chord type with the notes of said at least three fret positions for each said string, means for storing for each chord note which matches the note of a string-fret position intersection, a representation of the location of the match, means for checking that each note of a chord occurs in at least one match, means for removing for each chord note, for which there is exactly one match, all other matched string-fret notes on the same string, means for removing for each chord note for which there are exactly two matches, both matches occurring on the same string, all other matched string-fret notes on that same string, means for removing, for each chord note pair, each note of said pair occurring exactly twice, and one match from each pair occurring on each of two different strings whereby the notes have a mutual interdependency, all other matched string-fret notes on said two different strings, means for repeating at least once operation of said checking and all removing means in editing of the found matches when at least one match is found to be invalid, and means for graphically outputting on a single grid, a representation of each said allowable combination of chord note positions.

15. A graphical display means for displaying an exhaustive representation of positions for playing selected chord types on a stringed instrument comprising a regular array of grid elements, each grid element representing along a first axis the strings of said instrument and along a second axis the fret locations on the instrument, and said grid elements of said array being arranged in a first axial direction corresponding to each chord type and in a second axial direction corresponding to selected groupings of at least three fret locations.

16. The graphical display means of claim 15 further wherein each grid element comprises means for identifying at each string-fret position intersection, the note, if any, validly associated with the grid intersection and matching a note of the chord.

* * * * *